US008811851B2

(12) United States Patent
Otsuka et al.

(10) Patent No.: US 8,811,851 B2
(45) Date of Patent: Aug. 19, 2014

(54) IMAGE FORMING APPARATUS AND TRAPPING DEVICE

(75) Inventors: Yuji Otsuka, Kanagawa (JP); Hajime Yoshii, Kanagawa (JP); Masayuki Yamamiya, Kanagawa (JP); Teruyo Ryuzaki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 125 days.

(21) Appl. No.: 13/480,973

(22) Filed: May 25, 2012

(65) Prior Publication Data

US 2013/0101311 A1 Apr. 25, 2013

(30) Foreign Application Priority Data

Oct. 21, 2011 (JP) ..... 2011-231641

(51) Int. Cl.
*G03G 21/20* (2006.01)

(52) U.S. Cl.
USPC ..... 399/93; 55/490; 55/493

(58) Field of Classification Search
CPC . G03G 21/20; G03G 15/0258; G03G 21/206; G03G 2221/1684; B01D 46/42
USPC ..... 399/93; 55/490, 493
See application file for complete search history.

(56) References Cited

U.S. PATENT DOCUMENTS 7,320,524 B2 * 1/2008 Lee et al. ..... 353/60
7,466,545 B2 * 12/2008 Hung ..... 361/679.48

FOREIGN PATENT DOCUMENTS

JP 2003345217 A * 12/2003
JP 2011-085615 A 4/2011

* cited by examiner

*Primary Examiner* — Ryan Walsh
(74) *Attorney, Agent, or Firm* — Sughrue Mion, PLLC

(57) ABSTRACT

An image forming apparatus includes a housing, an image forming section, an air passage that is disposed so as to be movable between a first position and a second position, the air passage having an interior through which air is allowed to flow while the air passage is in the first position, a trapping member that is mountably and dismountably disposed in the interior of the air passage, the trapping member trapping an object contained in the air flowing through the interior of the air passage, and a mounting system that mounts the trapping member, which is not completely mounted in the interior of the air passage, in the interior of the air passage by an operation of moving the air passage from the second position to the first position.

9 Claims, 12 Drawing Sheets

IMAGE FORMING APPARATUS AND TRAPPING DEVICE

CROSS-REFERENCE TO RELATED APPLICATIONS

This application is based on and claims priority under 35 USC 119 from Japanese Patent Application No. 2011-231641 filed Oct. 21, 2011.

BACKGROUND

The present invention relates to an image forming apparatus and a trapping device.

SUMMARY

According to an aspect of the invention, an image forming apparatus includes a housing, an image forming section that is disposed in the housing and forms an image on a sheet, an air passage that is disposed so as to be movable between a first position at which the air passage is mounted in the housing and a second position at which the air passage is not completely mounted in the housing, the air passage having an interior through which air is allowed to flow while the air passage is in the first position, a trapping member that is mountably and dismountably disposed in the interior of the air passage, the trapping member trapping an object contained in the air flowing through the interior of the air passage, and a mounting system that mounts the trapping member, which is not completely mounted in the interior of the air passage, in the interior of the air passage by an operation of moving the air passage from the second position to the first position.

BRIEF DESCRIPTION OF THE DRAWINGS

An exemplary embodiment of the present invention will be described in detail based on the following figures, wherein.

DETAILED DESCRIPTION

Figure 1:
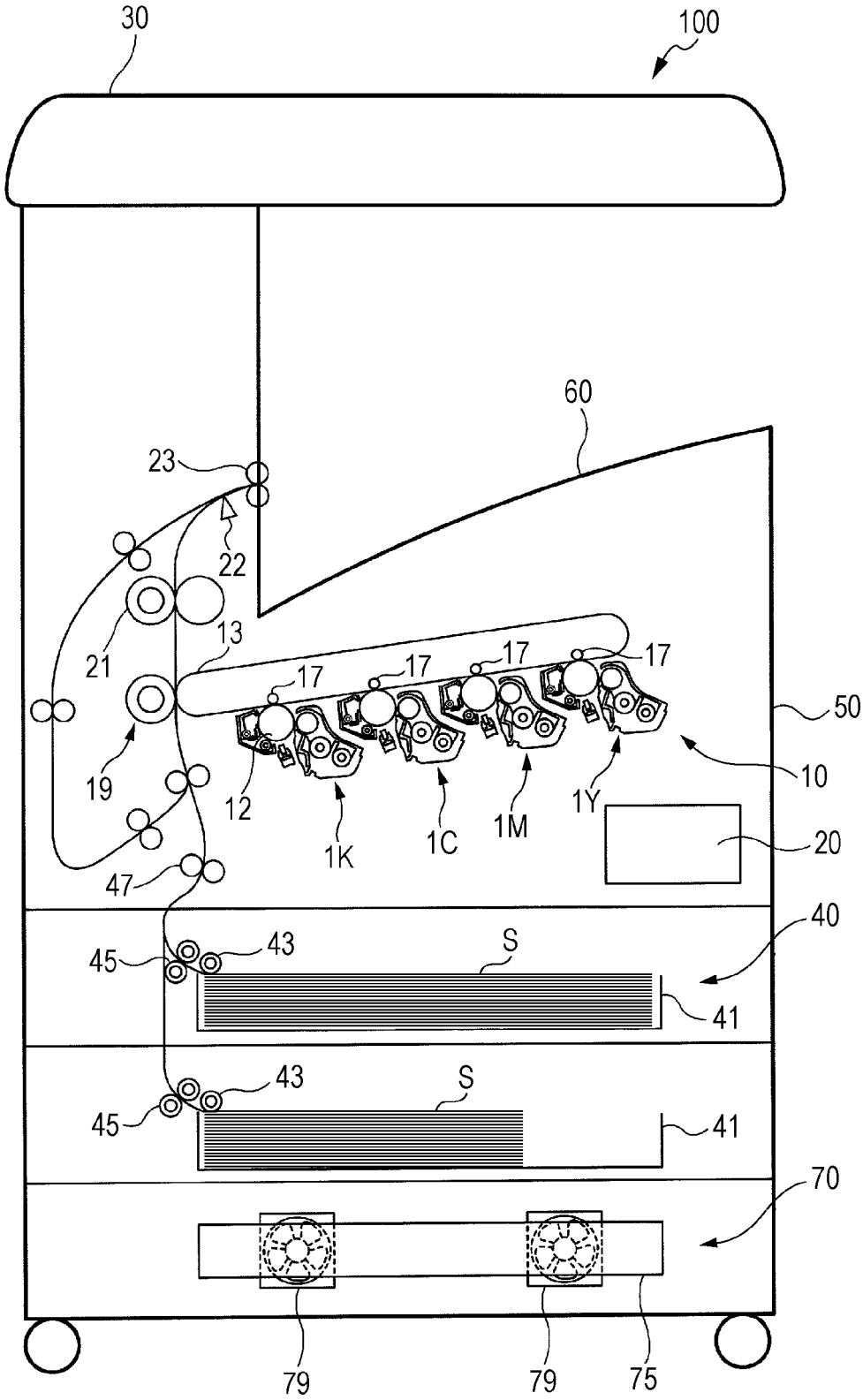
FIG. 1 is a schematic diagram of an image forming apparatus according to an exemplary embodiment of the present invention.

Referring to the drawings, an exemplary embodiment of the present invention will be described in detail below.

Image Forming Apparatus 100

FIG. 1 is a schematic diagram of an image forming apparatus 100 according to the exemplary embodiment. The image forming apparatus 100 illustrated in FIG. 1 is a so-called tandem color printer. The image forming apparatus 100 includes an image forming section 10, which forms an image in accordance with image data of different colors, and a controller 20, which controls operations of the image forming apparatus 100 as a whole. The image forming apparatus 100 also includes an image reading device 30, which is disposed on an upper side of the image forming apparatus 100. The image reading device 30 is a scanner that reads an image from an original document. The image forming apparatus 100 also includes sheet feeding sections 40 that feed sheets S to the image forming section 10.

Components of the image forming apparatus 100 are disposed inside a body housing (or housing) 50. The image forming apparatus 100 also has an inner stacking portion 60 below the image reading device 30 at an upper surface of the body housing 50. The inner stacking portion 60 has a stacking surface on which the sheets S having had images formed thereon by the image forming section 10 are stacked. The image forming apparatus 100 also includes an air purifying unit 70 that takes the air from outside the image forming apparatus 100 into the image forming apparatus 100 to purify the air.

Image Forming Section 10

The image forming section 10 includes four image forming units 1Y, 1M, 1C, and 1K, which are arranged side by side with certain intervals therebetween. Each of the image forming units 1Y, 1M, 1C, and 1K forms a toner image by a so-called electrophotographic system, and includes a photoconductor drum 12 on which an electrostatic latent image is formed and that carries the toner image. The image forming units 1Y, 1M, 1C, and 1K have the same configuration except for toners contained in corresponding developing devices. The image forming units 1Y, 1M, 1C, and 1K respectively form toner images of yellow (Y), magenta (M), cyan (C), and black (K). For this reason, components of the image forming units 1Y, 1M, 1C, and 1K are distinguished from one another by adding characters of "Y", "M", "C", and "K" in the following description, but these characters are not added to these components when the components do not need to be distinguished from one another.

The image forming section 10 includes an intermediate transfer belt 13 to which toner images of different colors formed on the photoconductor drum 12 of the image forming units 1 are transferred. The image forming section 10 also includes first transfer rollers 17 that sequentially transfer (first-transfer) the toner images of different colors formed by the image forming units 1 to the intermediate transfer belt 13. The image forming section 10 also includes a second transfer portion 19 that collectively transfers (second-transfers) the toner images of different colors, which are formed on the intermediate transfer belt 13 so as to be superposed on top of one another, to a sheet S, which is a recording medium (recording paper). The image forming section 10 also includes a fixing device 21 that fixes the second-transferred toner images of different colors to the sheet S.

The image forming section 10 also includes an exit sensor 22 that detects passing of the sheet S having had the toner images fixed thereto by the fixing device 21. The image forming section 10 also includes inner output rollers 23 that output the sheet S having passed the exit sensor 22 to the inner stacking portion 60.

Each sheet feeding section 40 includes a sheet container 41, a pick-up roller 43, separation rollers 45, and registration rollers 47. The sheet container 41 contains sheets S. The pick-up roller 43 is disposed at a portion above the sheet container 41 and picks up a topmost one of the sheets S contained in the sheet container 41. The separation rollers 45 separate the sheets S picked up by the pick-up roller 43 into individual sheets S and transport the sheets one by one. The registration rollers 47 temporarily stop the sheet S that has been separated and transported by the separation rollers 45, and then feed the sheet S to the second transfer portion 19 by resuming rotating at a right timing.

Structure of Air Purifying Unit 70

Figure 2:
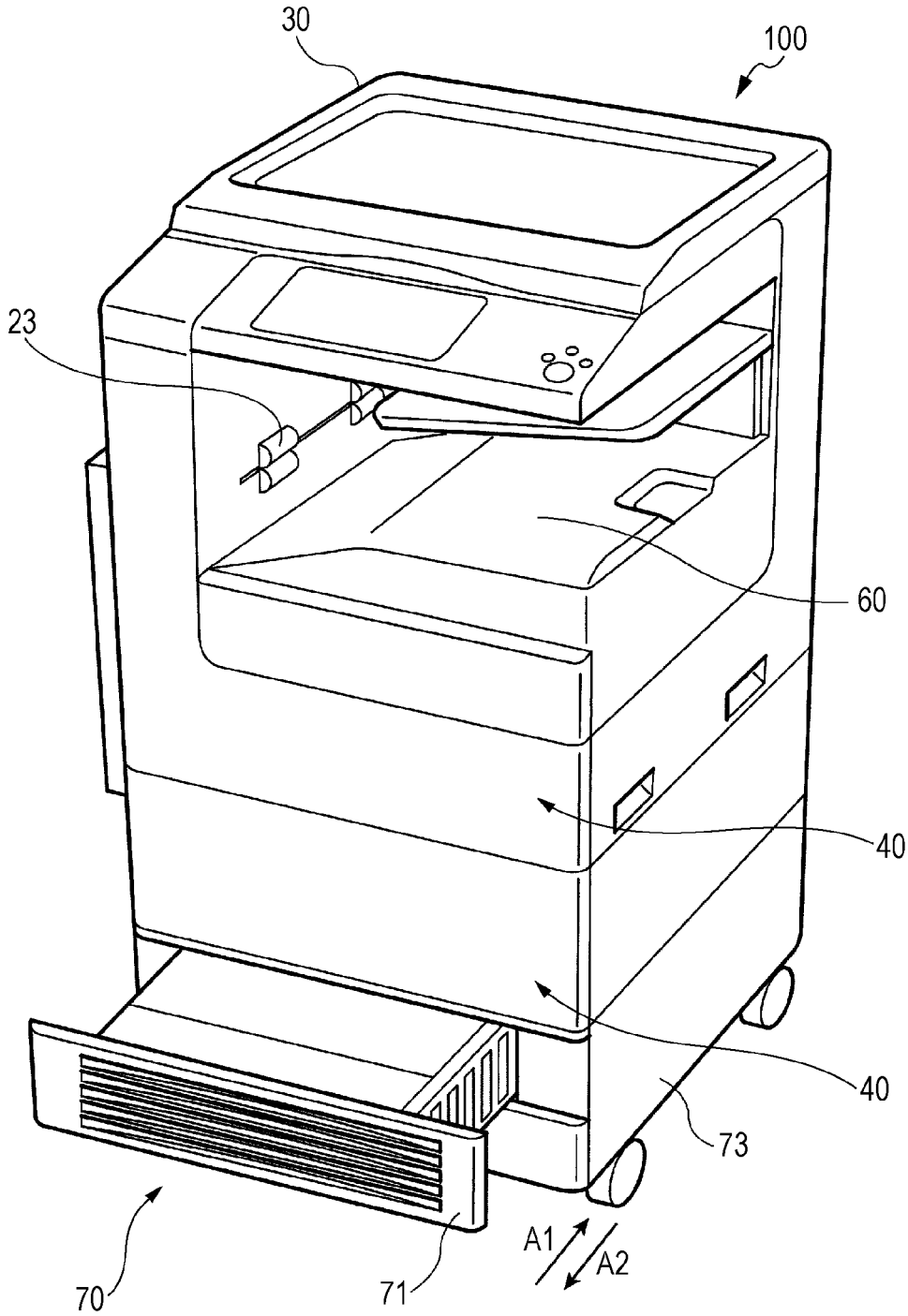
FIG. 2 is a perspective view of the image forming apparatus according to the exemplary embodiment.

Referring now to FIG. 2, the air purifying unit 70 will be described. FIG. 2 is a perspective view of the image forming apparatus 100 according to the exemplary embodiment.

In the exemplary embodiment, the air purifying unit 70, which is an example of a trapping device, is disposed at a lower portion of the image forming apparatus 100. More specifically, the air purifying unit 70 is disposed below the sheet feeding sections 40, and is mountable on and dismountable from the sheet feeding sections 40.

The air purifying unit 70 includes a cassette 71, which is capable of being pulled out (as indicated by the arrows A1 and A2 illustrated in FIG. 2), and a housing 73, which houses the cassette 71 therein and supports the cassette 71 such that the cassette 71 is capable of being pulled out. Hereinbelow, the cassette 71 and the housing 73 will be described.

Cassette 71

Figure 3:
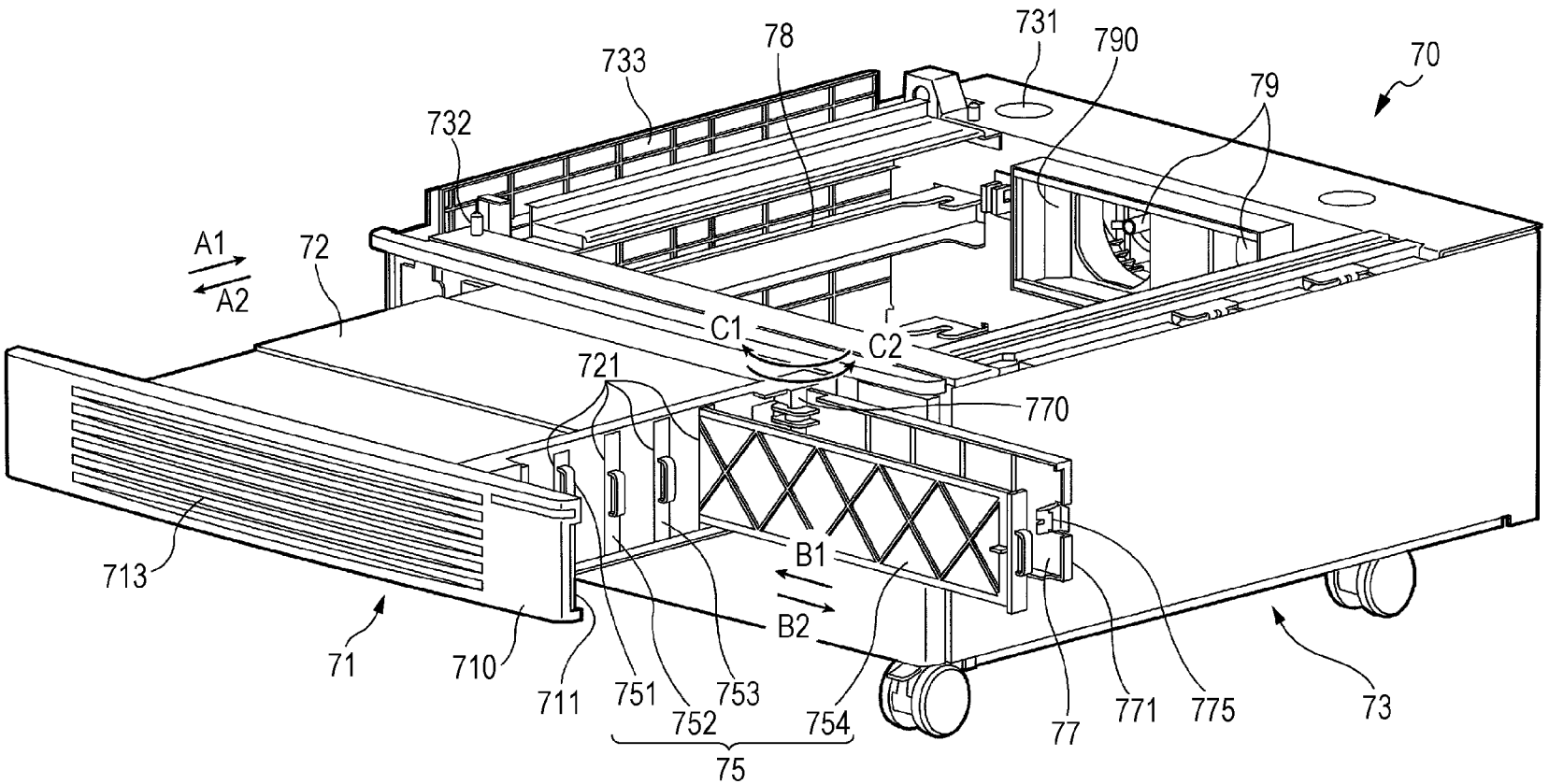
FIG. 3 is a perspective view of an air purifying unit according to the exemplary embodiment.
Figure 4A:
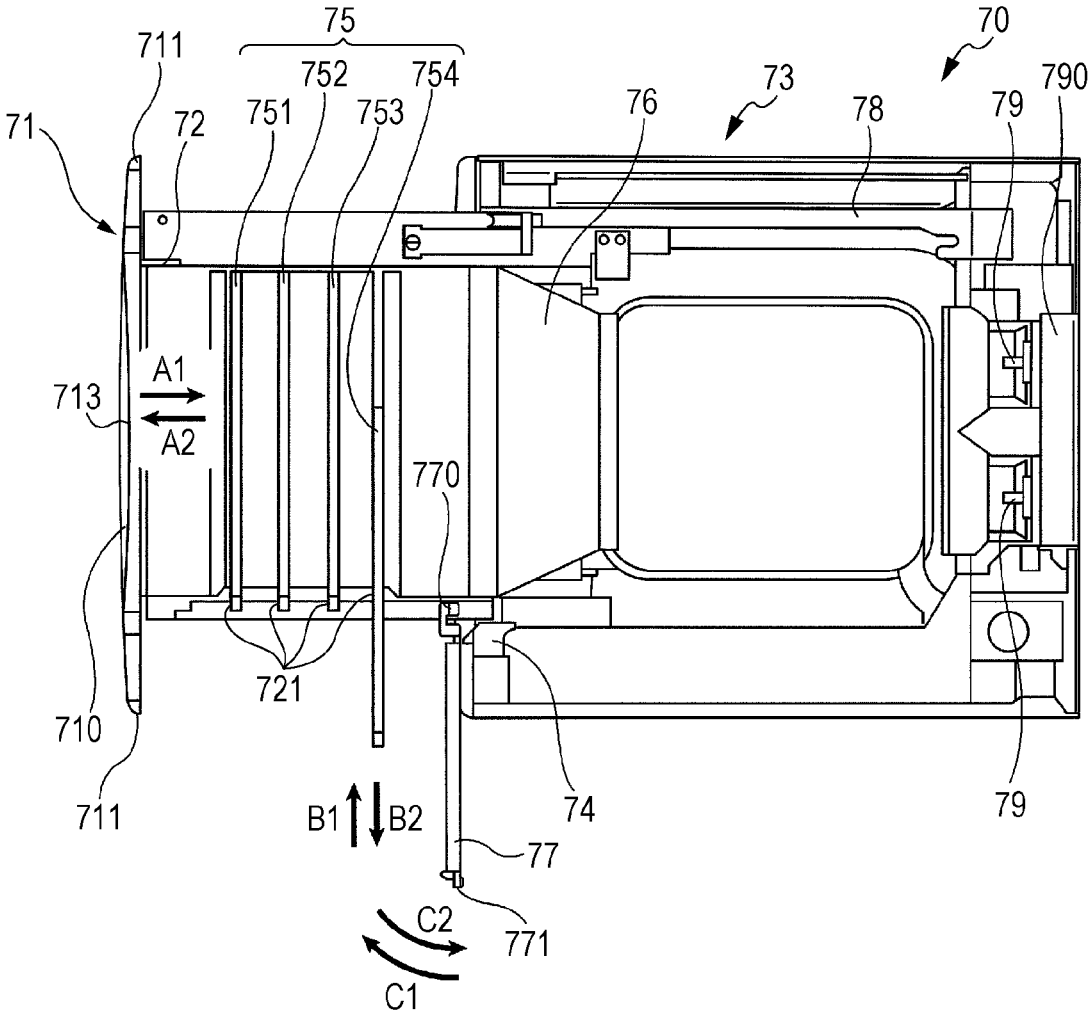
FIGS. 4A and 4B are top views of the air purifying unit according to the exemplary embodiment.
Figure 4B:
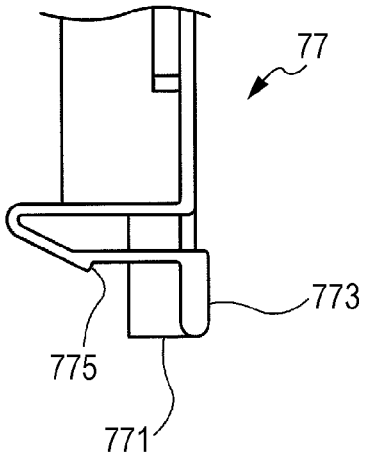
Figure 5:
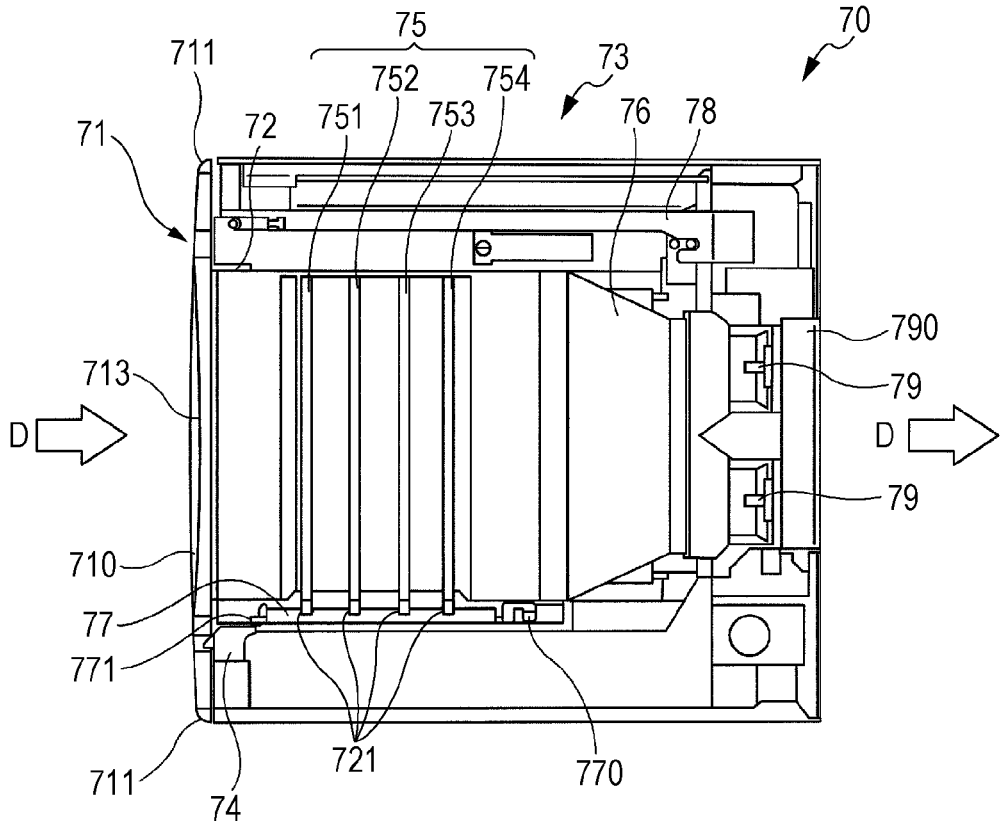
FIG. 5 is a top view of the air purifying unit in which a cassette is placed.

Referring to FIGS. 3 to 5, the cassette 71 will be firstly described. FIG. 3 is a perspective view of the air purifying unit 70 according to the exemplary embodiment, and FIGS. 4A and 4B are top views of the air purifying unit 70 according to the exemplary embodiment. More specifically, FIG. 4A is a top view of the air purifying unit 70 in which the cassette 71 is pulled out, and FIG. 4B is a schematic diagram of an end portion 771 of an inner cover 77. FIG. 5 is a top view of the air purifying unit 70 in which the cassette 71 is housed.

As illustrated in FIG. 3, the cassette 71 includes a front panel 710, which is a panel member that is disposed on a front side (near side of the plane of FIG. 1) of the image forming apparatus 100, and a duct (air passage) 72, which is an almost rectangular parallelepiped member made continuous from the front panel 710 and having an inner space through which air flows.

The front panel 710 includes grip portions 711, on which a user hooks his/her fingers to pull out the cassette 71, and air vents (louvers) 713, which are formed on the front side (near side of the plane of FIG. 1) of the front panel 710 and through which the air is taken into the air purifying unit 70.

The duct 72 extends from the front side (near side of the plane of FIG. 1) to the rear side (far side of the plane of FIG. 1) of the image forming apparatus 100, and forms a passage that allows the air taken from the air vents 713 to flow to fans 79 (described below) disposed on the rear side (far side of the plane of FIG. 1).

In the exemplary embodiment, the cassette 71 has multiple inlet ports (outlet ports) 721, into which multiple filters 75 (described below) are inserted, on a side portion of the duct 72. As illustrated in FIG. 4A, the cassette 71 has a narrowing portion 76, which narrows down a passage of the air lead to the fans 79, on the rear side (far side of the plane of FIG. 1) of the duct 72.

The cassette 71 also includes filters 75 (751, 752, 753, and 754) that remove airborne contaminants by causing the contaminants to adhere thereto to thus purify the air. The cassette 71 also includes an inner cover 77 (described later), which is formed so as to be openable and closable (as indicated by the arrows C1 and C2) and covers the side portion of the duct 72 into which the filters 75 are inserted.

Filter 75

Figure 6B:
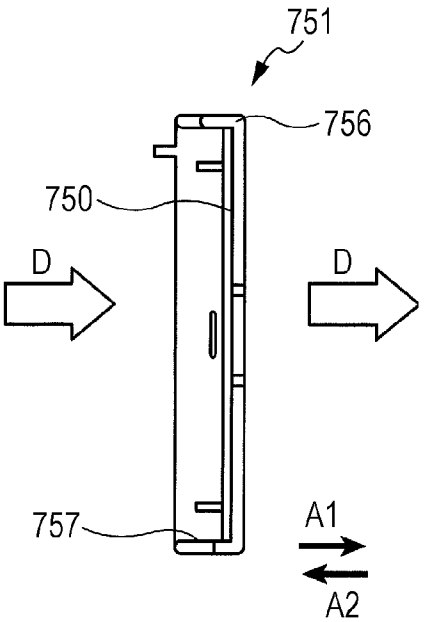
FIGS. 6A and 6B are schematic diagrams of a first filter.

Referring now to FIGS. 3 to 6B, the filters 75 will be described. FIGS. 6A and 6B are schematic diagrams of a first filter 751.

In the exemplary embodiment, the filters 75, which are examples of a trapping member or an air purifying member, include a first filter (or pre-filter) 751, a second filter 752, a third filter 753, and a fourth filter 754. The first filter 751 is a rough filter that traps a relatively large airborne dust, the second filter 752 is a fine filter that traps a relatively small airborne dust, the third filter 753 traps mites, molds, pollens, bacteria, viruses, and other objects, and the fourth filter 754 traps odorant objects such as a gaseous object.

In the illustrated example, the first filter 751, the second filter 752, the third filter 753, and the fourth filter 754 are arranged in this order from the front side (near side of the plane of FIG. 1) to the rear side (far side of the plane of FIG. 1) of the image forming apparatus 100. The number of filters, the types of filters, the order of arranging the filters, and other conditions are not limited to the illustrated example.

As illustrated in FIG. 5, the filters 75 are disposed inside the duct 72. Specifically, each filter 75 is disposed such that the plane of a filter body 750 (see FIG. 6A) intersects with an air flow passage (as indicated by the arrows D) that is defined by the duct 72. More specifically, each filter 75 is disposed over the entirety of the cross section of the air flow passage that is taken so as to intersect the passage.

As illustrated in FIG. 3, the filters 75 are capable of being pulled out from the duct 72 (as indicated by the arrows B1 and B2 illustrated in FIG. 3). Specifically, the filters 75 according to the exemplary embodiment are capable of being pulled out from the duct 72 in the horizontal direction.

The structure of the filters 75 will be described in detail now. Although the structure will be described by using the first filter 751 here, the second filter 752, the third filter 753, and the fourth filter 754 have the same structure except for filter bodies 750 (described below).

Figure 6A:
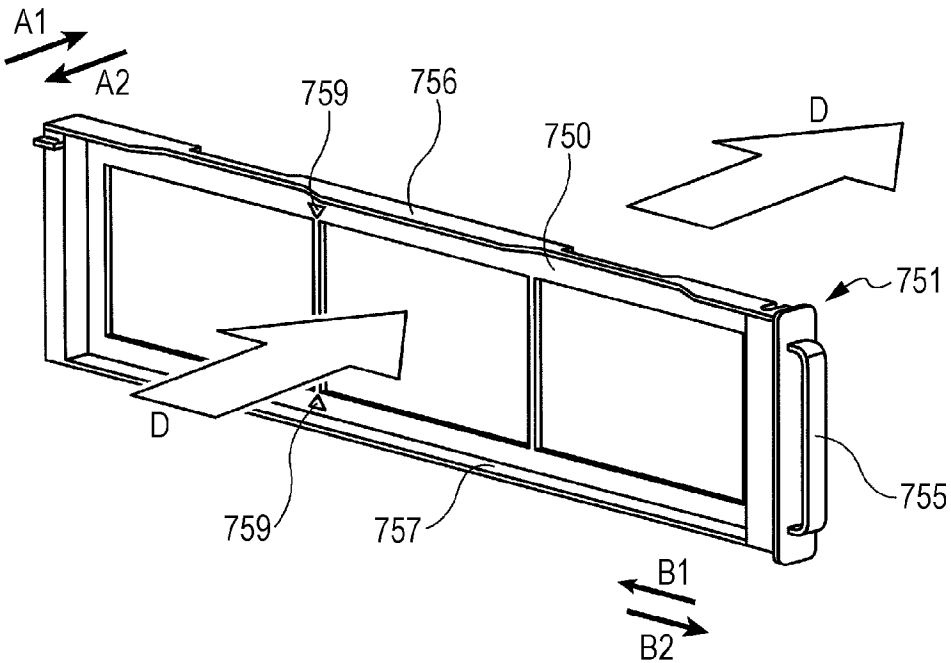

As illustrated in FIGS. 6A and 6B, the first filter 751 includes a filter body 750, which is a fibrous member made of resin or the like, and a frame 756, which holds the outer periphery of the filter body 750.

The frame 756 includes a handle portion 755 that a user grips to pull out the filter 75 (as indicated by the arrow B2) that has been inserted into the duct 72 (see FIG. 3).

The frame 756 also includes a receiving portion (projection) 757 that receives contaminants, such as dust, which have been trapped by the filter body 750 and have fallen from the filter body 750.

The receiving portion 757 is formed so as to be continuous from the frame 756 and disposed on a side that is further upstream in the air flow direction (as indicated by the arrows D) than the filter body 750 and below the filter body 750. The receiving portion 757 receives the dust in the case, for example, where the first filter 751 is subjected to an impact by inserting the cassette 71 into the air purifying unit 70, and thus the contaminants such as dust that have adhered to the filter body 750 fall from the filter body 750. Consequently, the contaminants such as dust are less likely to fall inside the duct 72. More specifically, the contaminants such as dust that are received by the receiving portion 757 are taken out of the duct 72 and the air purifying unit 70 by pulling out the first filter 751 from the duct 72.

The frame 756 has a mark 759 (described below) that indicates a position up to which the first filter 751 is to supposed be inserted into the duct 72 in advance (see FIG. 3). In the exemplary embodiment, the mark 759 is formed in such a form as to protrude from the frame 756, but the mark 759 may have another configuration that is recognizable by a user, for example, may be formed as a groove or by changing the color of part of the frame 756.

Inner Cover 77

Now, the inner cover 77 will be described with reference to FIGS. 3 to 5.

The inner cover 77 is a plate member and is disposed on a side portion of the duct 72. The inner cover 77 is disposed on the duct 72 so as to be rotatable around one end portion thereof and is openable and closable with respect to the duct 72.

The inner cover 77 has such dimensions as to cover all the multiple inlet ports 721 disposed on the side portion of the duct 72. When the inner cover 77 is closed, the inner cover 77 covers the side portion of the duct 72 at which the inlet ports 721 are formed, so that the air is less likely to flow into the duct 72 through the inlet ports 721.

The inner cover 77 has a rotating shaft 770 at an downstream end portion in a direction in which a user inserts the cassette 71 into the housing 73 (as indicated by the arrow A1), or, at a rear (far side of the plane of FIG. 1) end portion of the image forming apparatus 100. The rotating shaft 770 is disposed so as to extend in the vertical direction. Thus, the inner cover 77 is rotatable around the rotating shaft 770 in directions along the horizontal plane (as indicated by the arrows C1 and C2 illustrated in FIG. 3). In this manner, the inner cover 77 is capable of being switched between the open state (see FIG. 4A) and the closed state (see FIG. 5).

As illustrated in FIGS. 4A and 4B, the inner cover 77 includes a claw portion 775 at an end portion 771 that is opposite the portion at which the rotating shaft 770 is disposed. The claw portion 775 is engaged with part of the duct 72 in the state where the inner cover 77 is closed. The inner cover 77 also includes a protruding portion 773 at the end portion 771. The protruding portion 773 protrudes in a direction that is opposite to that of air flowing through the duct 72 in the state where the inner cover 77 is closed.

While the cassette 71 is housed in the housing 73, the inner cover 77 is rotated (as indicated by the arrow C1) around the rotating shaft 770 by being pressed by a guide member 74 (described below). By being rotated in this manner, the inner cover 77 is closed. As the inner cover 77 is closed, the inner cover 77 pushes the filters 75, which have not been completely inserted into the duct 72, into the duct 72.

Housing 73

Now, the housing (housing structure) 73 will be described with reference to FIGS. 3 to 5.

As illustrated in FIG. 4A first, the housing 73 includes a guide member 74 (described below) that comes into contact with the inner cover 77 and thus closes the inner cover 77 together with the operation of inserting the cassette 71 into the housing 73. The housing 73 according to the exemplary embodiment forms part of the body housing 50.

The housing 73 includes a rail 78 that extends in a direction in which the cassette 71 is pulled out (as indicated by the arrow A2 illustrated in FIG. 2) and that supports the cassette 71 such that the cassette 71 is capable of being pulled out. The housing 73 also includes fans 79 at the rear side (far side in the plane of FIG. 1). The fans 79 suck the outside air into the air purifying unit 70 and cause the air to pass through the filters 75. The housing 73 also includes an exhaust port 790 through which the air sucked by the fans 79 is ejected to the outside of the air purifying unit 70 (the image forming apparatus 100 (see FIG. 1)).

As illustrated in FIG. 3, the housing 73 also includes a fixing hole 731, a fixing pin 732, and a support panel 733, which are defined as examples of a fixing portion. The fixing portion receives the sheet feeding sections 40 (see FIG. 1), which are disposed on the top of the housing 73, and fixes the sheet feeding sections 40 such that the sheet feeding sections 40 are mountable on and dismountable from the housing 73.

Guide Member 74

Figure 7:
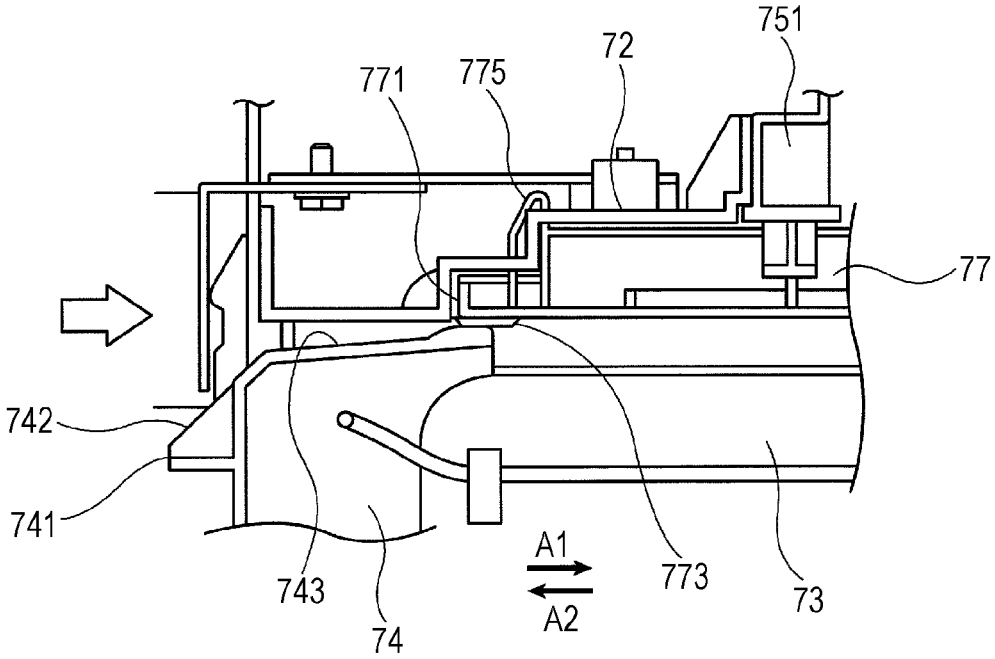
FIG. 7 illustrates the surroundings of a guide member.

Referring now to FIGS. 4A and 7, the guide member 74 will be described. FIG. 7 illustrates the surroundings of the guide member 74.

As illustrated in FIG. 4A, the guide member 74 is disposed in the housing 73 at the front side (near side of the plane of FIG. 1, or left side of the plane of FIG. 4A) of the image forming apparatus 100 (see FIG. 1) so as to face the side portion of the cassette 71 that is inserted in the housing 73. More specifically, the guide member 74 is disposed on an orbit along which the inner cover 77, which is disposed on the cassette 71, moves when the inner cover 77, which is in the open state, is moved together with the operation of inserting the cassette 71 into the housing 73.

As illustrated in FIG. 7, the guide member 74 includes a first contact surface (first contact portion) 741, a second contact surface (second contact portion) 742, and a third contact surface 743. The first contact surface 741 protrudes toward the front (near side of the plane of FIG. 1, or left side of the plane of FIG. 7) of the image forming apparatus 100 and comes into contact with the inner cover 77 when the inner cover 77 is open. The second contact surface 742 is a surface facing the duct 72 and pushes the inner cover 77, which is in the open state, toward the duct 72. The third contact surface 743 is a surface facing the duct 72 and pushes the inner cover 77, which is in the open state, toward the duct 72 further than the second contact surface 742 does. In the example illustrated in FIG. 7, the second contact surface 742 is positioned on a side that is further downstream in the direction of inserting the cassette 71 (as indicated by the arrow A1) and on a side that is closer to the inner cover 77 than the first contact surface 741. The third contact surface 743 is positioned on a side that is further downstream in the direction of inserting the cassette 71 (as indicated by the arrow A1) and on a side that is closer to the inner cover 77 than the second contact surface 742.

Here, the inner cover 77 and the guide member 74 may be defined as a mounting system. The inner cover (pushing portion) 77 and the guide member (pressing portion) 74 are arranged in the following manner. Specifically, the inner cover 77 and the guide member 74 are arranged such that the guide member 74 comes into contact with the inner cover 77, which is in the open state, to close the inner cover 77 as the cassette 71 is inserted into the housing 73 (as indicated by the arrow A1). More specifically, the guide member 74 is positioned on a side that is further downstream in the direction of inserting the cassette 71 into the housing 73 (as indicated by the arrow A1) than the inner cover 77, which is in the open state.

In addition, the inner cover 77 is disposed such that the filters 75 are pushed into the duct 72 by the inner cover 77 by closing the inner cover 77. More specifically, the filters 75 are positioned closer to the duct 72 in the direction of closing the inner cover 77 (as indicated by the arrow C1) than the inner cover 77 is.

With the above mounting system, the guide member 74 comes into contact with the inner cover 77, which is in the open state, as the cassette 71 is inserted into the housing 73 (as indicated by the arrow A1). The inner cover 77 that has come into contact with the guide member 74 receives a force directed toward the front (near side of the plane of FIG. 1) of the image forming apparatus 100 (see FIG. 1) from the guide member 74, and thus rotates (as indicated by the arrow C1) around the rotating shaft 770 disposed at the end portion of the inner cover 77 on the rear side (far side of the plane of FIG. 1) of the image forming apparatus 100. Here, the inner cover 77 rotates in a direction of closing the inner cover 77. The inner cover 77 comes into contact with the filters 75 as the inner cover 77 is closed. The filters 75 that have come into contact with the inner cover 77 are pushed into the duct 72 by being further pressed by the inner cover 77.

As described above, when the cassette 71 is inserted into the housing 73 (as indicated by the arrow A1) while the inner cover 77 is in the open state, the inner cover 77 is closed by the guide member 74. The inner cover 77 that is being closed pushes the filters 75 into the duct 72. In other words, as a result of the operation of opening the inner cover 77 according to the exemplary embodiment, the inner cover 77 is made ready to push the filters 75.

As described above, when the inner cover 77 is in the closed state, the inner cover 77 covers the filters 75. Thus, the inner cover 77 has to be opened when the filters 75 are to be replaced with new ones (described later). Accordingly, while the filters 75 are replaced in the exemplary embodiment, the inner cover 77 is in the open state, that is, the inner cover 77 is ready to push the filters 75.

Thus, the cassette 71 is prevented from being inserted into the housing 73 (as indicated by the arrow A1) without the filters 75 being pushed by the inner cover 77. In addition, according to the exemplary embodiment, a user does not have to perform an operation of disposing the inner cover 77 at a predetermined position or orientation in advance, or other operations in order to make the inner cover 77 function correctly.

State of Air Purifying Unit 70

Referring now to FIGS. 4A and 5, the state of the air purifying unit 70 in which the cassette 71 is pulled out of the housing 73 and the state in which the cassette 71 is housed in the housing 73 will be described.

Firstly, as illustrated in FIG. 4A, in the air purifying unit 70 in which the cassette 71 is pulled out, the duct 72 is exposed to the outside and the inner cover 77 is in the state of being rotatable around the rotating shaft 770 (as indicated by the arrows C1 and C2). That is, the inner cover 77 is in the state of being openable and closable. As illustrated in FIG. 4A, in the state where the cassette 71 is pulled out from the housing 73 and the inner cover 77 is open, the filters 75 are capable of being pulled out from and inserted into the duct 72 (as indicated by the arrows B1 and B2).

On the other hand, in the air purifying unit 70 in which the cassette 71 is housed in the housing 73 as illustrated in FIG. 5, the inner cover 77 extends along the duct 72. That is, the inner cover 77 is in the closed state. When the inner cover 77 is closed, the claw portion 775 formed at the end portion 771 of the inner cover 77 is engaged with part the duct 72 (see FIG. 7). In addition, when the inner cover 77 is closed, a surface of the inner cover 77 facing the duct 72 is in contact with the filters 75 and thus prevents the filters 75 from moving in directions indicated by the arrows B1 and B2.

A position of the duct 72 while the cassette 71 is housed in the housing 73 as illustrated in FIG. 5 may be defined as a first position, and a position of the duct 72 while the cassette 71 is pulled out (is not completely mounted in the housing 73) as illustrated in FIG. 4A may be defined as a second position.

Operation of Air Purifying Unit 70

Now, the operation of the air purifying unit 70 will be described.

Firstly, when the fans 79 that are controlled by the controller 20 (see FIG. 1) are driven, the air outside of the image forming apparatus 100 (see FIG. 1) is taken in through the air vents 713 (see FIG. 3).

The intaken air flows through the duct 72 (as indicated by the arrows D) as illustrated in FIG. 5 and passes through the first filter 751, the second filter 752, the third filter 753, and the fourth filter 754. As the air passes through the filters 75, the airborne contaminants are removed by the filters 75 by adhering to the filters 7. Thus, the air is purified.

The purified air passes through a passage area that is narrowed by the narrowing portion 76 and then is ejected to the outside of the image forming apparatus 100 (see FIG. 1), i.e., to the outside of the air purifying unit 70, through the fans 79 and the exhaust port 790.

After the air purifying unit 70 has been used for a predetermined period, the user replaces or cleans the filters 75 so that the air purifying unit 70 maintains its air purification performance. For example, the first filter 751 is cleaned once every month, and the second filter 752, the third filter 753, and the fourth filter 754 are replaced with new ones once every six months.

Now, the operation of the air purifying unit 70 when the filters 75 are replaced will be described.

Firstly, a user pulls out the cassette 71 that has been housed in the housing 73 as illustrated in FIG. 5 (as indicated by the arrow A2) toward the front of the image forming apparatus 100 (near side of the plane of FIG. 1).

Then, the user opens the inner cover 77 (as indicated by the arrow C2) that has been disposed along the duct 72 of the pulled-out cassette 71 at the side portion of the duct (or that has been in the closed state) as illustrated in FIG. 4A. Thereafter, the user pulls out (as indicated by the arrow B2) the filters 75 that have been inserted in the inlet ports 721 of the duct 72.

The user inserts new filters 75 (or the filters 75 that have been pulled out and cleaned) into the inlet ports 721 of the duct 72 (as indicated by the arrow B1) and then closes the inner cover 77 (as indicated by the arrow C1). Thereafter, the user places the cassette 71 back in the housing 73 (as indicated by the arrow A1).

Operation of Guide Member 74

Referring now to FIGS. 8A to 8H, the operation of the guide member 74 will be described. FIGS. 8A to 8H illustrate the operation of the guide member 74.

Figure 8C:
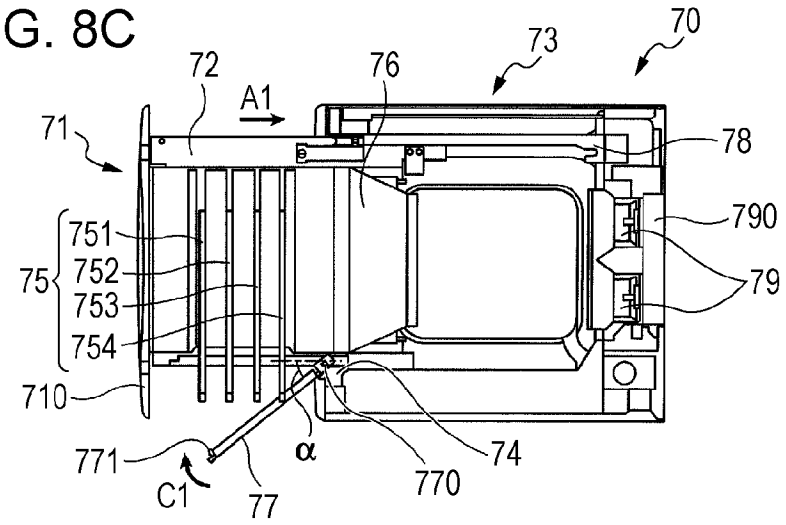
FIGS. 8A, 8B, 8C, 8D, 8E, 8F, 8G, and 8H illustrate operations of the guide member.
Figure 8D:
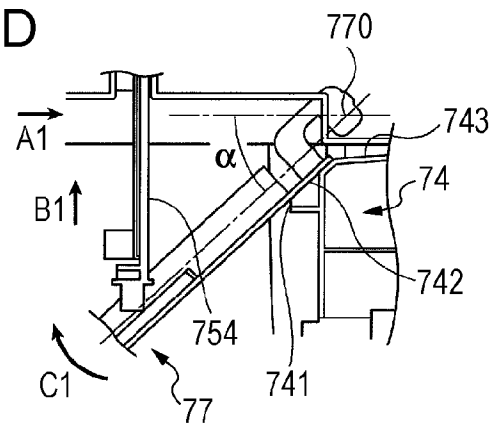
Figure 8A:
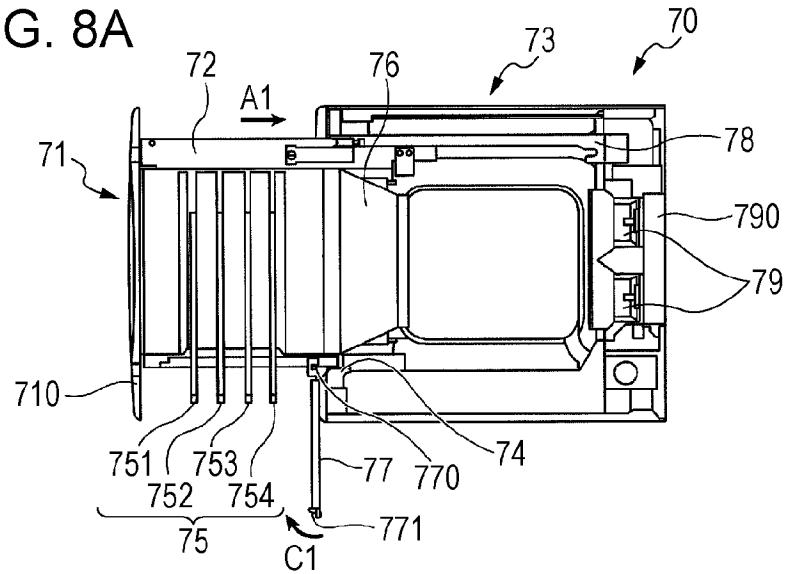
Figure 8B:
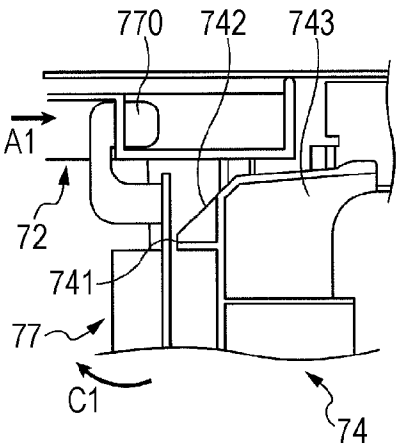

In the state illustrated in FIGS. 8A and 8B, the cassette 71 is pulled out from the housing 73 and the inner cover 77 is opened, and each of the filters 75 is not entirely inserted in the duct 72 but partly protrudes from the duct 72.

In the case, for example, where the user does not completely insert the filters 75 into the duct 72 (where the filters 75 are only partly mounted or are not disposed at a completely mounted position), the filters 75 partly protrude from the duct 72, as described above. In this state, when the user places the cassette 71 back in the housing 73, the inner cover 77 is closed and the filters 75 are inserted into the duct 72. More specifically, as the user places the cassette 71 back in the housing 73, the guide member 74 and the inner cover 77 insert the filters 75 into the duct 72.

Now, the operation will be described more specifically.

Firstly, as illustrated in FIGS. 8A and 8B, as the user places the cassette 71 back in the housing 73 (as indicated by the arrow A1), the inner cover 77 approaches the guide member 74 and then comes into contact with the first contact surface 741 of the guide member 74. The inner cover 77, which is pressed by the first contact surface 741, starts rotating around the rotating shaft 770 (as indicated by the arrow C1).

As illustrated in FIGS. 8C and 8D, as the user pushes the cassette 71 into the housing 73 (as indicated by the arrow A1) further, the guide member 74 causes the inner cover 77 to rotate further (as indicated by the arrow C1) while the second contact surface 742 is in contact with the inner cover 77. Then, the inner cover 77 comes into contact with the handle portion 755 of the fourth filter 754 that partly protrudes from the duct 72, as illustrated in FIG. 8D. As the inner cover 77 rotates further (as indicated by the arrow C1) from this state, the fourth filter 754 is pressed and inserted into the duct 72 by the inner cover 77 (as indicated by the arrow B1).

Figure 8G:
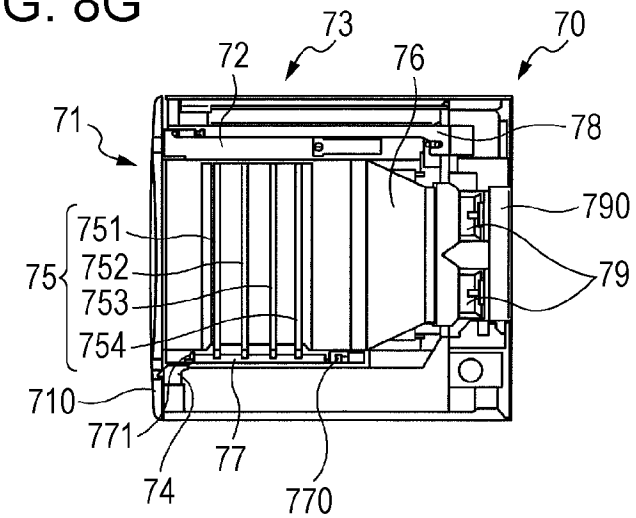
Figure 8H:
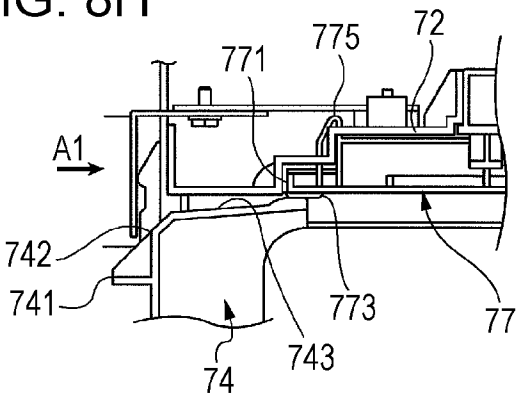
Figure 8E:
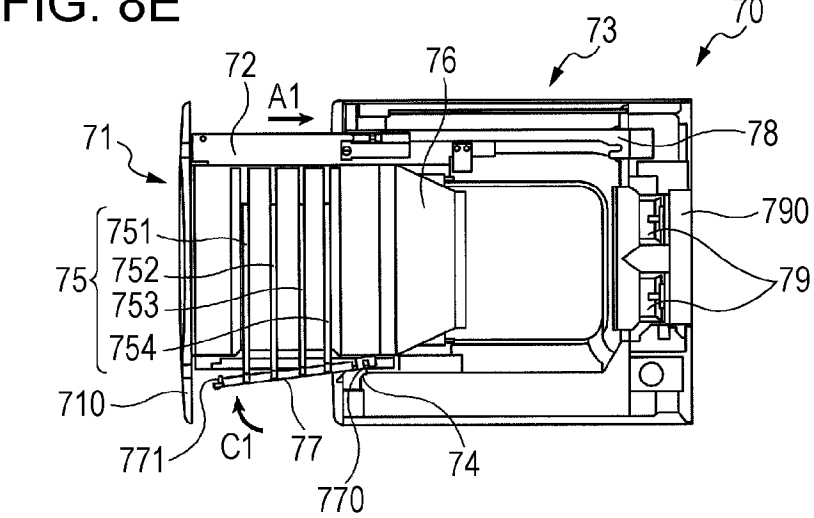
Figure 8F:
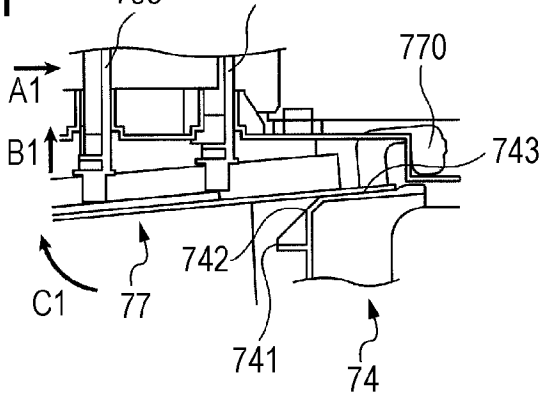

Thereafter, as the cassette 71 is further pushed into the housing 73 by the user as illustrated in FIGS. 8E and 8F (as indicated by the arrow A1), the guide member 74 causes the inner cover 77 to rotate further (as indicated by the arrow C1) while the third contact surface 743 is in contact with the inner cover 77. As the inner cover 77 rotates further, the inner cover 77 also comes into contact with and presses the third filter 753, the second filter 752, and the first filter 751, which protrude from the duct 72. As the inner cover 77 rotates further from this state (as indicated by the arrow C1), the third filter 753, the second filter 752, and the first filter 751 are inserted into the duct 72 (as indicated by the arrow B1).

As illustrated in FIGS. 8G and 8H, as the cassette 71 is pushed further into the housing 73 by the user (as indicated by the arrow A1), the protruding portion 773 of the inner cover 77 that protrudes in a direction opposite to that of the air flowing through the duct 72 moves along the third contact surface 743 in the arrow A1 direction. While the protruding portion 773 moves along the third contact surface 743, the protruding portion 773 is in contact with the third contact surface 743 and receives a force toward the duct 72 from the third contact surface 743. Then, the claw portion 775 formed on the duct 72 side of the inner cover 77 becomes engaged with the duct 72. Accordingly, the inner cover 77 is prevented from being separated from the duct 72.

With this operation, the entirety of the fourth filter 754 is inserted into the duct 72 by the guide member 74 and the inner cover 77. Similarly, the entireties of the third filter 753, the second filter 752, and the first filter 751 are inserted into the duct 72 by the guide member 74 and the inner cover 77.

In the exemplary embodiment, the guide member 74 and the inner cover 77 cooperatively insert the filters 75, which partly protrude from the duct 72, into the duct 72 as the cassette 71 is inserted into the housing 73 as described above.

In the exemplary embodiment, the filters 75 are allowed to be replaced only when the inner cover 77 is in the state of being capable of inserting the filters 75 into the duct 72.

On the other hand, in the exemplary embodiment, since the filters 75 are entirely inserted into the duct 72 at the same time as the cassette 71 is housed in the housing 73, the efficiency with which the filters 75 purifies the air is maintained.

As described above, in the exemplary embodiment, even the filters 75, which partly protrude from the duct 72, are entirely inserted into the duct 72 by the guide member 74 and the inner cover 77 by placing the cassette 71 in the housing 73.

In the exemplary embodiment, the guide member 74 pushes the filters 75 toward the duct 72 via the inner cover 77 that is disposed on the duct 72 so as to be openable and closable.

In contrast, in the exemplary embodiment, the filters 75 are pushed by the inner cover 77 that starts rotating after coming into contact with the guide member 74 as described above.

Position Up to which Filters 75 are Inserted

Figure 9:
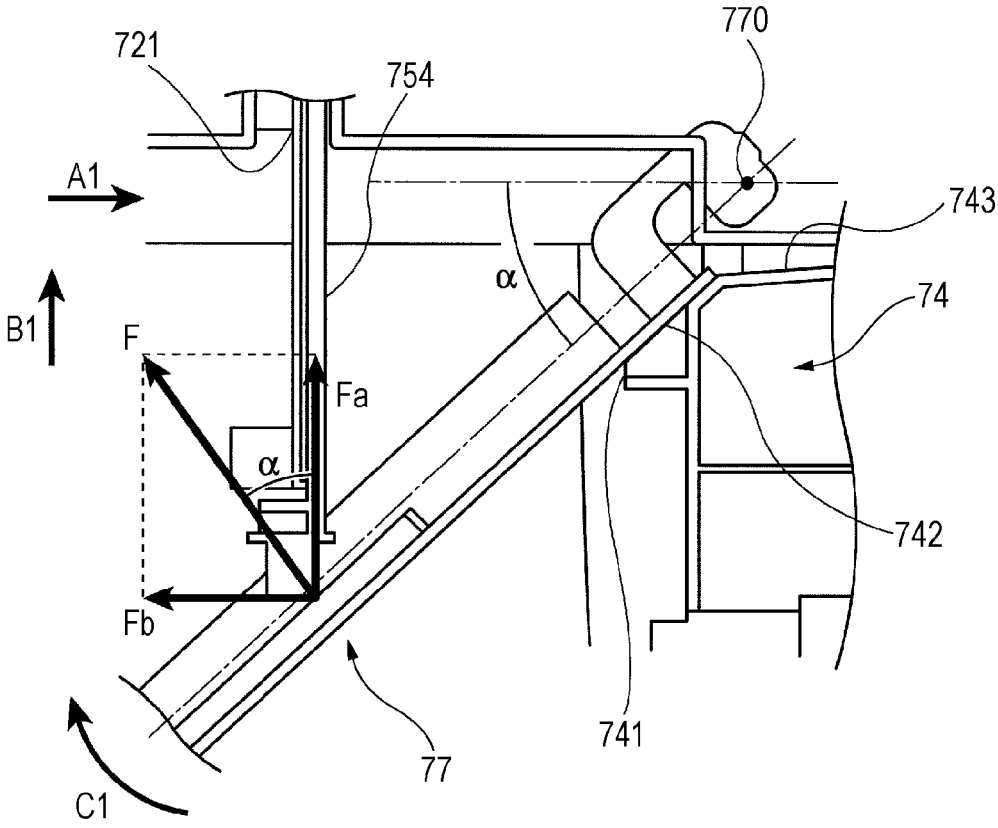
FIG. 9 illustrates a positional relationship between an inner cover and a filter.

Referring now to FIG. 9, positions up to which the filters 75 are inserted will be described. FIG. 9 illustrates the positional relationship between the inner cover 77 and the filters 75.

As illustrated in FIG. 9, components of a force F, which is a force of the inner cover 77 that pushes a filter 75 (fourth filter 754 in FIG. 9) are specified as a force component Fa and a force component Fb. The force component Fa is directed in a direction in which the fourth filter 754 is inserted into the duct 72 (as indicated by the arrow B1). The force component Fb is directed in a direction in which the cassette 71 is pulled out from the housing 73 (as indicated by the arrow A2 in FIG. 4A).

An angle formed by the inner cover 77 and the direction in which the cassette 71 is inserted into the housing 73 (as indicated by the arrow A1) is defined as an angle $\alpha$. When the inner cover 77 presses the fourth filter 754 at the angle $\alpha$ that is smaller than 45 degrees, the force component Fa that is directed in a direction of inserting the fourth filter 754 into the duct 72 (as indicated by the arrow B1) is larger than the force component Fb that is directed in a direction of pulling out the cassette 71 (as indicated by the arrow A2 of FIG. 4A).

Thus, when the inner cover 77 is positioned with respect to the fourth filter 754 such that the inner cover 77 presses the fourth filter 754 at the angle $\alpha$ that is smaller than 45 degrees, the inner cover 77 is capable of efficiently inserting the fourth filter 754 into the duct 72. More specifically, when the inner cover 77 is positioned with respect to the fourth filter 754 such that the inner cover 77 starts pressing the fourth filter 754 at the angle $\alpha$ that is smaller than 45 degrees, the inner cover 77 is capable of more securely inserting the fourth filter 754 into the duct 72.

As illustrated in FIG. 6A, in the exemplary embodiment, the frame 756 of each filter 75 has a mark 759 in order to aid positioning of the inner cover 77 with respect to the filter 75 such that the inner cover 77 starts pressing the filter 75 at the angle $\alpha$ that is smaller than 45 degrees. Referring to FIGS. 3 and 6A, at the time of inserting the filter 75 into the inlet port 721 of the duct 72, if a user inserts the filter 75 up to the position indicated by the mark 759, the inner cover 77 is disposed at such a position that the inner cover 77 starts pressing the filter 75 at the angle $\alpha$ that is equal to or smaller than 45 degrees. The mark 759 functions as a guide to help the user insert the filter 75.

Modification

Figure 10:
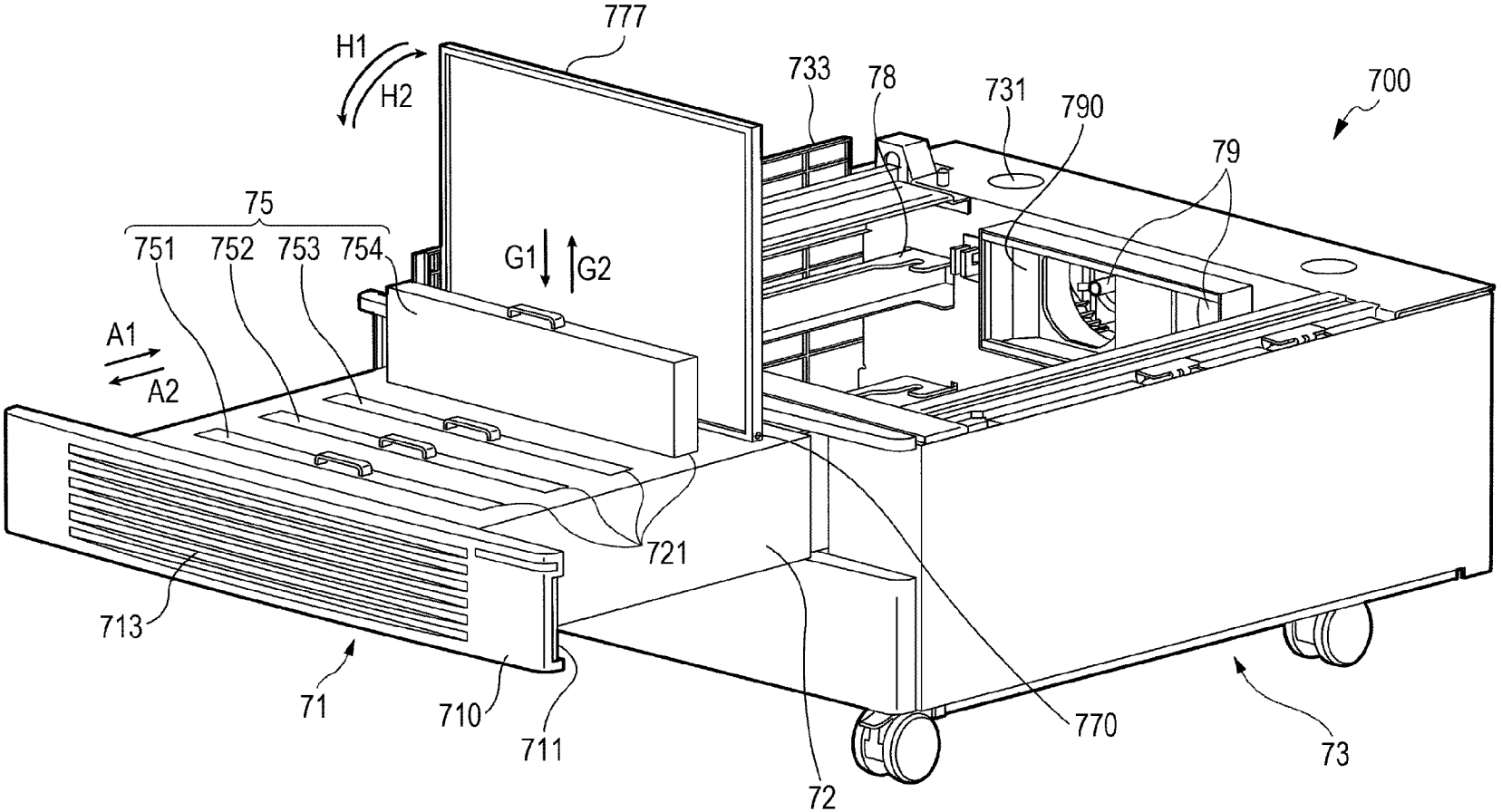
FIG. 10 is a perspective view of an air purifying unit according to a modification.

Referring now to FIG. 10, a modification will be described. FIG. 10 is a perspective view of an air purifying unit 700 according to the modification.

As illustrated in FIG. 10, multiple inlet ports 721 are formed in an upper surface of the duct 72 in the air purifying unit 700. Accordingly, in the air purifying unit 700, the filters 75 are capable of being vertically inserted into and pulled out from the duct 72 (as indicated by the arrows G1 and G2 in FIG. 10).

An inner cover 777 has such dimensions as to cover all the inlet ports 721 formed in the upper surface of the duct 72. When the inner cover 777 is closed, the inner cover 777 covers the upper surface of the duct 72 in which the inlet ports 721 are formed, so that the air is less likely to flow into the duct 72 through the inlet ports 721. The inner cover 777 has a rotating shaft 770 at an end portion thereof on the rear side (far side of the plane of FIG. 1) of the image forming apparatus 100. The rotating shaft 770 is disposed in the horizontal direction in the example illustrated in FIG. 10. Thus, the inner cover 777 is rotatable around the rotating shaft 770 (as indicated by the arrows H1 and H2).

In this modification, the filters 75 are capable of being inserted into the duct 72 (as indicated by the arrow G1) by the weight of themselves. In addition, the inner cover 777 is capable of pressing the filters 75 in the direction of inserting the filters 75 into the duct 72 by the weight of itself.

Figure 11A:
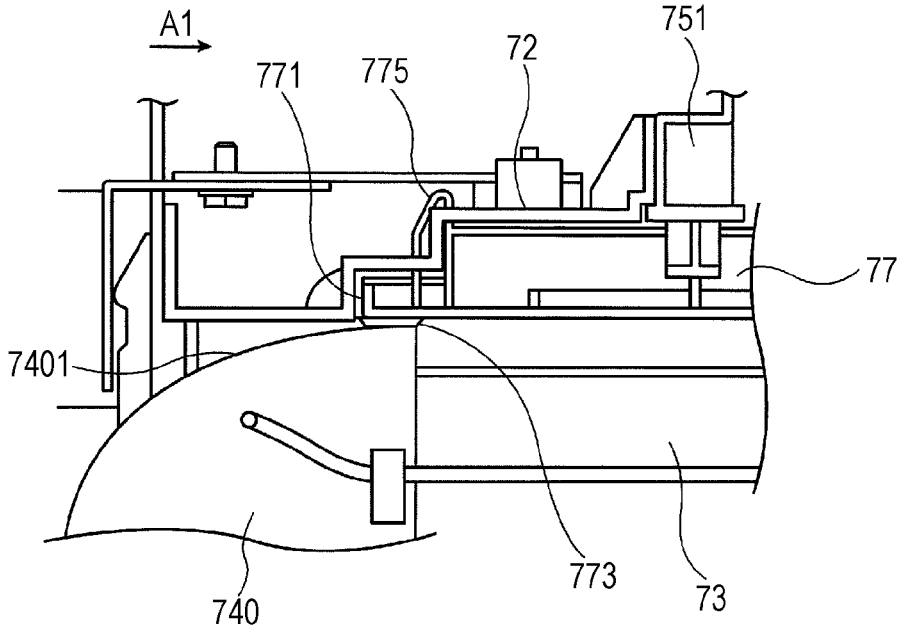
FIGS. 11A and 11B are perspective views of guide members according to modifications.
Figure 11B:
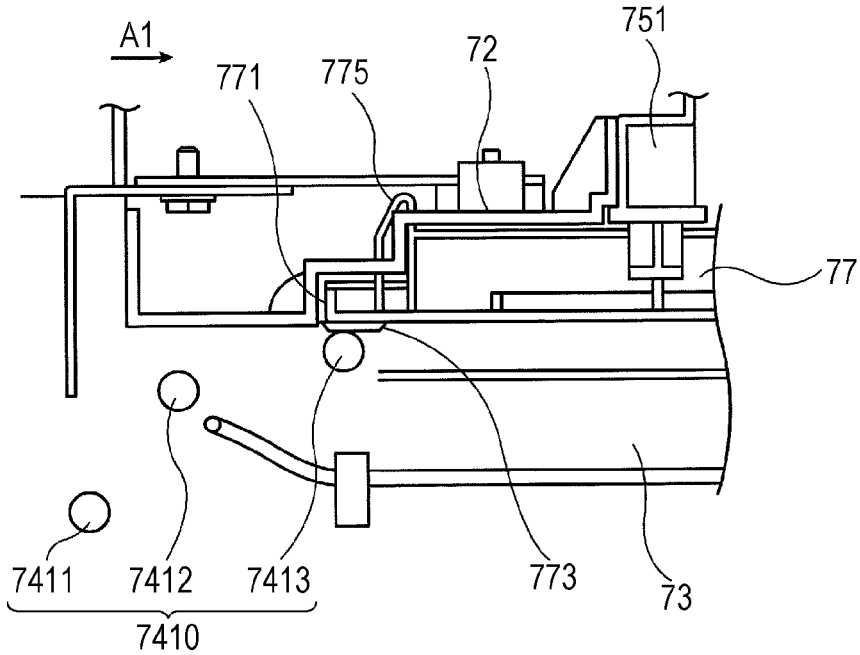

Referring now to FIGS. 11A and 11B, modifications of the guide member 74 will be described. FIGS. 11A and 11B are perspective views of guide members 740 and 7410 according to the modifications.

In the above-described exemplary embodiment, it is described that the guide member 74 includes the first contact surface 741, the second contact surface 742, and the third contact surface 743. However, the present invention is not limited thereto.

For example, as illustrated in FIG. 11A, the guide member 740 may have a curved surface 7401 that protrudes toward the inner cover 77. The curved surface 7401 closes the inner cover 77 by sequentially coming into contact with different portions of the inner cover 77 as the cassette 71 (see FIG. 3) is inserted further.

Alternatively, as illustrated in FIG. 11B, the guide member 7410 may include multiple components. In the example illustrated in FIG. 11B, the guide member 7410 includes a first pin 7411, a second pin 7412, and a third pin 7413. The second pin 7412 is positioned on a side that is closer to the inner cover 77 and on a side that is further downstream in the direction of inserting the cassette 71 (see FIG. 3) (as indicated by the arrow A1) than the first pin 7411. The third pin 7413 is positioned on a side that is closer to the inner cover 77 and on a side that is further downstream in the direction of inserting the cassette 71 (see FIG. 3) (as indicated by the arrow A1) than the second pin 7412.

The first pin 7411, the second pin 7412, and the third pin 7413 sequentially come into contact with the inner cover 77 as the cassette 71 (see FIG. 3) is inserted further, and thus the inner cover 77 is closed.

In the exemplary embodiment, it is described that the fans 79 are disposed on the rear side (far side of the plane of FIG. 1) of the image forming apparatus 100 as illustrated in FIG. 5. However, the present invention is not limited to this. For example, the fans 79 may be disposed on the front side (near side of the plane of FIG. 1) of the image forming apparatus 100.

In the exemplary embodiment, it is described that the air taken through the air vents 713 is caused to flow from the front (near side of the plane of FIG. 1) to the rear (far side of the plane of FIG. 1) and is ejected from the exhaust port 790 to the outside of the air purifying unit 70. However, the present invention is not limited to this. For example, in contrast to the exemplary embodiment, the air may be taken through the air vents that are disposed on the rear side to flow from the rear to the front and then to be ejected from the front side to the outside of the air purifying unit 70.

According to an exemplary embodiment of the present invention, an image forming apparatus includes an apparatus body, an image forming section that is disposed in the apparatus body and forms an image on a sheet, an air passage that is disposed in the apparatus body so as to be capable of being pulled out and has an interior through which air that is taken therein flows, an air purifying member that is disposed in the interior of the air passage so as to be capable of being pulled out and that purifies the air flowing through the interior of the air passage, and a mounting system that mounts the air purifying member, which has been pulled out from the air passage, on the air passage by an operation of placing the air passage that has been pulled out from the apparatus body back in the apparatus body. In the exemplary embodiment, the air purifying member is made less likely to be damaged when the air passage that has been pulled out is housed in the apparatus body.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a housing;

an image forming section that is disposed in the housing and forms an image on a sheet;

an air passage that is disposed so as to be movable between a first position at which the air passage is mounted in the housing and a second position at which the air passage is not completely mounted in the housing, the air passage having an interior through which air is allowed to flow while the air passage is in the first position;

a trapping member that is mountably and dismountably disposed in the interior of the air passage, the trapping member is movable in the air passage between a mounted position and an incomplete mounted position, the trapping member trapping an object contained in the air flowing through the interior of the air passage at the mounted position; and a mounting system that moves the trapping member in the air passage from the incomplete mounted position to the mounted position by an operation of moving the air passage from the second position to the first position.

2. The image forming apparatus according to claim 1, wherein the mounting system includes a pushing portion and a pressing portion, the pushing portion being disposed to the air passage and pushing the trapping member, which is not completely mounted in the interior of the air passage, into the air passage, the pressing portion pressing the pushing portion to push the trapping member into the air passage by an operation of moving the air passage that is disposed at the second position to the first position.

3. The image forming apparatus according to claim 2, wherein the air passage has an outlet port that is an opening through which the trapping member is pulled out, and wherein the pushing portion covers the outlet port of the air passage.

4. The image forming apparatus according to claim 2, wherein the pushing portion includes a rotating shaft on a downstream side in a direction of movement of the air passage from the second position to the first position, and wherein the pushing portion pushes the trapping member into the air passage while rotating around the rotating shaft by being pressed by the pressing portion.

5. The image forming apparatus according to claim 2, wherein the pushing portion is disposed on the air passage so as to be openable and closable, and when the pushing portion is opened, the pushing portion is pressed by the pressing portion when the air passage is moved from the second position to the first position.

6. The image forming apparatus according to claim 2, wherein the pressing portion includes a first contact portion and a second contact portion, the first contact portion being disposed on the housing and contacts the pushing portion, the second contact portion being disposed on a side that is further downstream in a direction of movement of the air passage from the second position to the first position than the first contact portion and disposed so as to be closer to the air passage than the first contact portion, the second contact portion contacts the pushing portion.

7. The image forming apparatus according to claim 1 further comprising:

a frame that supports the trapping member and is mountably and dismountably disposed in the interior of the air passage together with the trapping member, the frame including a projection below the trapping member, the projection projecting toward an upstream side of the air flowing through the interior of the air passage.

8. An image forming apparatus comprising:

a housing;

an image forming section that is disposed in the housing and forms an image on a sheet;

an air passage that is disposed so as to be movable between a first position at which the air passage is mounted in the housing and a second position at which the air passage is not completely mounted in the housing, the air passage having an interior through which air is allowed to flow while the air passage is in the first position;

a trapping member that is mountably and dismountably disposed in the interior of the air passage, the trapping member trapping an object contained in the air flowing through the interior of the air passage; and a mounting system that mounts the trapping member, which is not completely mounted in the interior of the air passage, in the interior of the air passage by an operation of moving the air passage from the second position to the first position, wherein a plurality of the trapping members are arranged in a direction in which the air flows in the interior of the air passage.

9. A trapping device comprising:

a housing structure;

a fixing portion that is disposed in the housing structure and fixes the housing structure to an image forming apparatus such that the housing structure is mountable on and dismountable from the image forming apparatus;

an air passage that is disposed so as to be movable between a first position at which the air passage is mounted on the housing structure and a second position at which the air passage is not completely mounted on the housing structure, the air passage having an interior through which air is allowed to flow while the air passage is in the first position;

a trapping member that is mountably and dismountably disposed in the interior of the air passage, the trapping member is movable in the air passage between a mounted position and an incomplete mounted position, the trapping member trapping an object contained in the air flowing through the interior of the air passage at the mounted position; and a mounting system that moves the trapping member in the air passage from the incomplete mounted position to the mounted position by an operation of moving the air passage from the second position to the first position.

* * * * *